US005445211A

United States Patent [19]

Tolve et al.

[11] Patent Number: 5,445,211

[45] Date of Patent: Aug. 29, 1995

[54] ROLLS FOR STRIP CONTINUOUS CASTING MACHINES

[75] Inventors: Pietro Tolve; Riccardo Tonelli, both of Rome; Romeo Capotosti, Narni, all of Italy

[73] Assignee: Centro Sviluppo Materiali S.p.A., Rome, Italy

[21] Appl. No.: 969,838

[22] PCT Filed: May 29, 1992

[86] PCT No.: PCT/EP92/01204

§ 371 Date: Mar. 17, 1993

§ 102(e) Date: Mar. 17, 1993

[87] PCT Pub. No.: WO92/21459

PCT Pub. Date: Dec. 10, 1992

[30] Foreign Application Priority Data

May 30, 1991 [IT] Italy ..... RM91A0374

[51] Int. Cl.[6] ..... B22D 11/06

[52] U.S. Cl. ..... 164/428; 164/480

[58] Field of Search ..... 164/428, 480

[56] References Cited

FOREIGN PATENT DOCUMENTS

| | | | |
|---|---|---|---|
| 0025098 | 3/1981 | European Pat. Off. . | |
| 0360635 | 3/1990 | European Pat. Off. | 164/428 |
| 0380698 | 8/1990 | European Pat. Off. . | |
| 60-15050 | 1/1985 | Japan | 164/428 |
| 60-15051 | 1/1985 | Japan | 164/428 |
| 60-162556 | 8/1985 | Japan | 164/480 |
| 3-216242 | 9/1991 | Japan | 164/428 |

*Primary Examiner*—J. Reed Batten, Jr.
*Attorney, Agent, or Firm*—Oliff & Berridge

[57] ABSTRACT

Rolls are provided for a strip continuous casting machine. Each roll has an outer cylindrical surface and two flat bases attached perpendicular to the rotational axis of each roll. Each base has an annular reinforcing element positioned on the edge between the base and the cylindrical surface. The annular element is made of at least one flange having a material resistant to the wear caused by mutual contact between the surface of the rolls and the confinement plates.

10 Claims, 4 Drawing Sheets

ROLLS FOR STRIP CONTINUOUS CASTING MACHINES

FIELD OF INVENTION

The present invention relates to rolls used in strip continuous casting machines.

More particularly, the invention relates to rolls used to minimize the problems of liquid metal confinement due to wear caused by mutual contact between the surfaces of the rolls and the corresponding lateral confinement plates.

Prior art

In the field of continuous casting, it is of particular interest to cast the molten metal directly as thin strip, thus permitting the total or partial elimination of hot rolling steps.

In this field, for the steel the development of the technology comprising the use of casting machines with counter-rotating rolls is particularly promising.

Such machines cast molten metal in an ingot mold formed by two counter-rotating rolls with parallel rotating axes laying on a same horizontal plane, and by two lateral plates in contact with the terminal flat bases of said rolls.

The counter-rotating rolls are usually made of steel. Their surface is cooled by pressure circulating water. The rolls are kept close to each other divided by a constant gap which allows strips to be obtained of a desired thickness. Usually, one of the rolls is movable, to change the gap existing between the rolls. This movement being actuated by hydraulic pistons.

The plates are substantially formed of refractory material, in contact with the flat bases of the rolls and with the molten metal and are supported by a metallic frame.

Special pushers, (e.g., spring means) push the plates against said flat bases to ensure the necessary sealing and to hold the liquid metal.

Said sealing means is subject to particularly heavy working conditions. In fact, besides always present high thermal loads, there is a continuous friction between the plates and the flat bases of the rolls that causes wear of the contact surfaces, with following infiltrations of metal between said surfaces.

The infiltrated metal has a strong and negative influence on the surface quality of the product edges and on the casting yield, and can often stop the rotation of the rolls.

A number of attempts were made to improve the lateral confinement. However, up to now, no satisfactory improvement has been obtained in the quality of products and in the plant productivity.

For instance, it has been tried to increase the contact pressure between plates and rolls to improve their contact.

Thus, monolithic plates have been produced of wear resistant refractory materials, such as alumina or silica. Additionally, some stellite platelets have been laid on the rolls, in correspondence to the contact zones with the plates.

However, such suggestions do not satisfactorily solve the described drawbacks.

SUMMARY OF THE INVENTION

It has now been found that an improvement in the sealing between lateral plates and rolls can be obtained by laying a number of flanges on the rolls, in correspondence to the contact-area. The flanges are resistant to wear and to thermal cycling.

The purpose of the present invention is, therefore, the production of a poll bearing an annular reinforcing element as a flange made of a wear and thermal cycling resisting material. The annular reinforcing element is positioned in the contact zone with the plates.

Another purpose of the present invention is the realization of a strip continuous casting machine comprising polls bearing an annular reinforcing element as a flange made of a wear and thermal cycling resisting material. Again, the annular reinforcing element is positioned in the contact zone with the plates.

Further purposes of present invention shall be evident from the following description of the invention.

DETAILED DESCRIPTION OF THE INVENTION

The roll, according to the present invention, is formed by an outer cylindrical surface and by two flat bases perpendicular to the potation axis of the poll. The roll is characterized by the fact that on each of the bases, in correspondence to the edge between them and the cylindrical surface, an annular reinforcing element is placed, made up by at least one flange realized in a material resistant to wear and to thermal cycling (particularly to thermal cracks).

It is in fact clear, from the kind of stress borne by the polls duping the continuous casting, that the materials to be used to produce said flanges must have such characteristics as to be able to bear sudden thermal shocks in the order of 1000° C. or more.

The annular reinforcing element according to the present invention can be put on each flat base-of the roll as a one-piece flange or preferably as a flange formed by a plurality of parts, each having the form of a ring segment. The parts are juxtaposed and not welded to each other. The gap being provided between the extremities of such parts in order to not prevent deformations and length variations due to thermal dilatation of the materials constituting the flanges.

In the gap thus provided between the extremities of said ring segments some soft metal platelets, such as copper, can be advantageously inserted, as sealing means. During the working time the soft metal platelets are compressed between the extremities of such segments, compensating for length variations.

The annular reinforcing element is connected to each of the roll bases, preferably by means of bolts.

A particularly preferred embodiment requires for each bolt to have a housing in the form of an oval-shaped seating on the flange. This permit the circumferential movement of the flanges during the operation. The flanges thus obtained can cope with both the radial and circumferential movement.

Strip continuous casting machines using the Polls according to the present invention include: (i) a couple of counter-rotating rolls whose rotation axes are parallel to each other, the rolls being on a same horizontal plane, the axes of the rolls are apart by a distance greater than the some of the rolls radii, each of the rolls having an outer cylindrical surface and two flat bases perpendicular to the rotation axis of the rolls, and (ii) a couple of confinement plates placed against said flat bases, defining (iii) a cavity in which the liquid metal is cast, said rolls are characterized in that to each of said bases, in correspondence with the edge formed between same bases and said cylindrical surface, flanges are connected made up of materials resisting to wear and to thermal cycling (particularly to thermal cracks).

List of Figures

The present invention will be now described in greater detail with reference to the enclosed drawings, which show the invention purely as example and in no way limit the purposes of the invention itself.

FIG. 1 is a general schematic view of the device for strip continuous casting in which the rolls of the present invention can be used, FIG. 2 is a schematic view of part of a roll according to the invention, FIG. 3 is a schematic view of a preferred junction between a roll and a flange, FIG. 4 is a schematic lateral view, perpendicular to the roll axis, showing, on a 90° arc, the connecting system between roll and flange. It is composed by oval-shaped seatings on the flange, which accept bolts to fix the flange to the roll.

Figure 1:
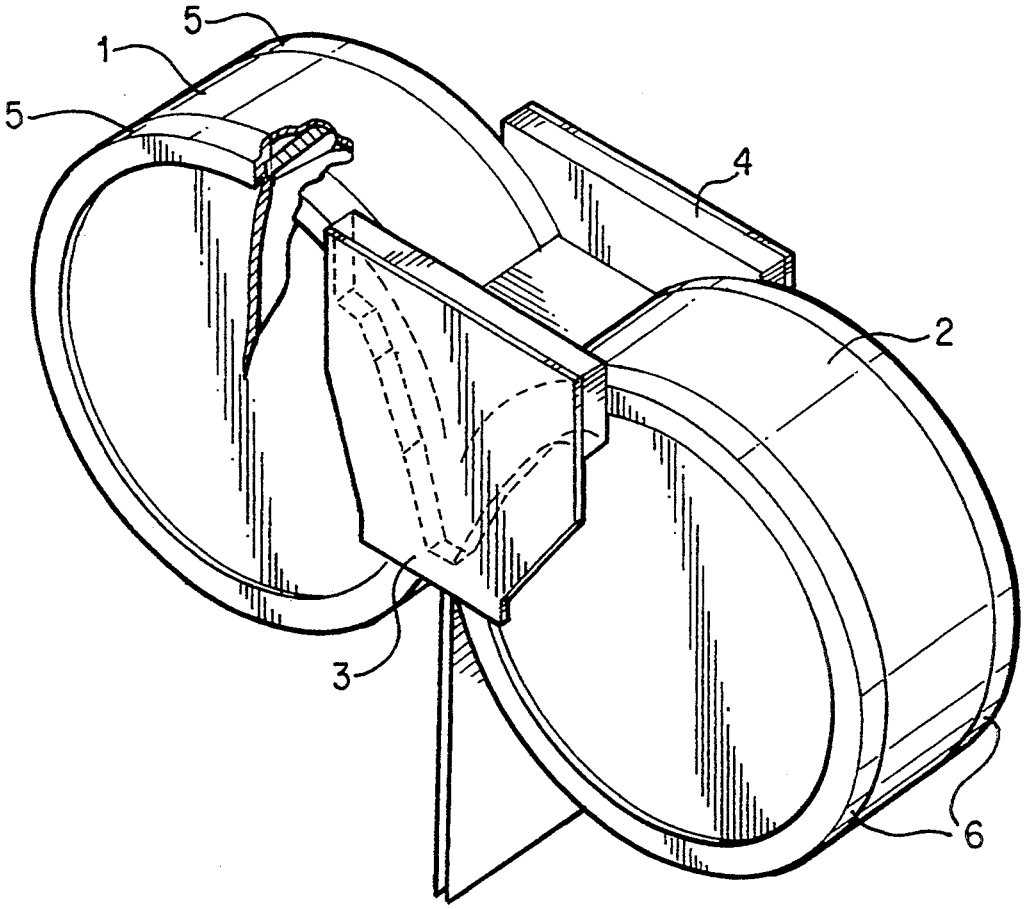
Figure 2:
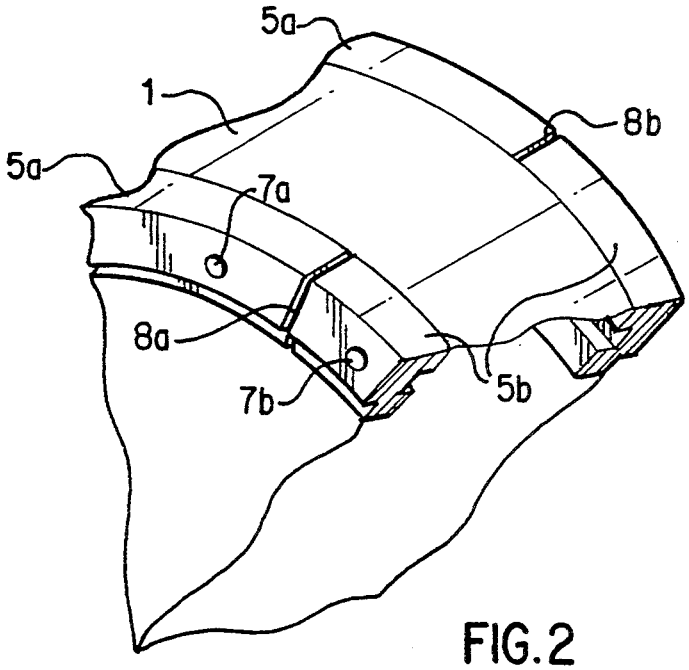

With reference to FIG. 1, in a continuous casting machine, the liquid metal is cast in a cavity formed by two counter-rotating rolls 1 and 2, and by two confinement plates 3 and 4, symmetrically placed with reference to the flat bases of rolls 1 and 2, and comprising refractory plates in contact with the metal bath and with the rolls. The rolls bear flanges 5 and 6 according to the invention. A part of roll 1 is shown in FIG. 2 highlighting the junction between two sectors of the flange. According to this embodiment, the flange is divided into parts in the form of ring segments 5*a* and 5*b* and is mounted with bolts on the edge of the roll. The seatings 7*a* and 7*b* are for the bolts on the ring segments 5*a* and 5*b*.

The ring segments 5*a* and 5*b* are not in reciprocal contact, but are spaced by a gap 8*a* or 8*b*, to compensate for deformations and length variations due to thermal dilatation of the materials of the flanges.

Figure 5:
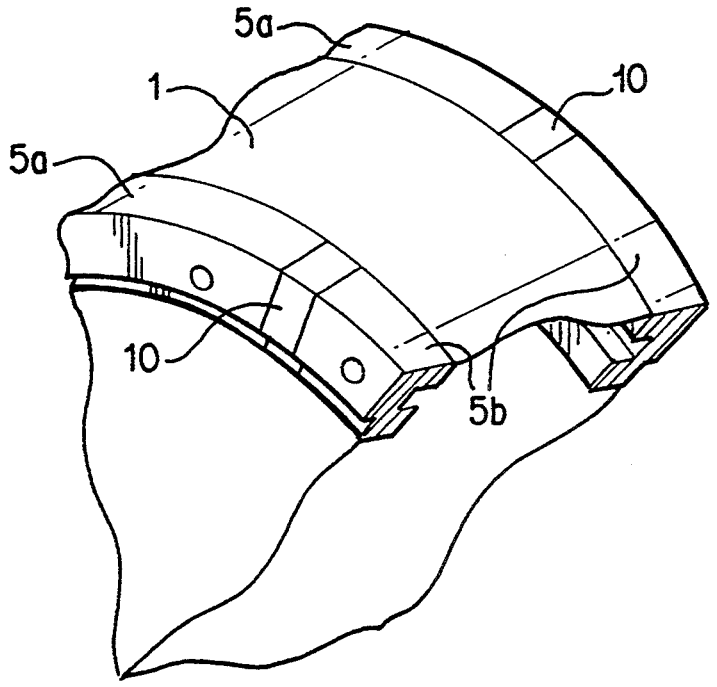
FIG. 5 is a schematic view of part of a roll showing a soft metal in the gap.

As shown in FIG. 5, the gap is filled with blocks of soft metal 10, such as copper to avoid spilling of molten metal. The soft metal 10 can be easily compressed between the extremities of the flange segments, still maintaining a proper seal.

Figure 3:
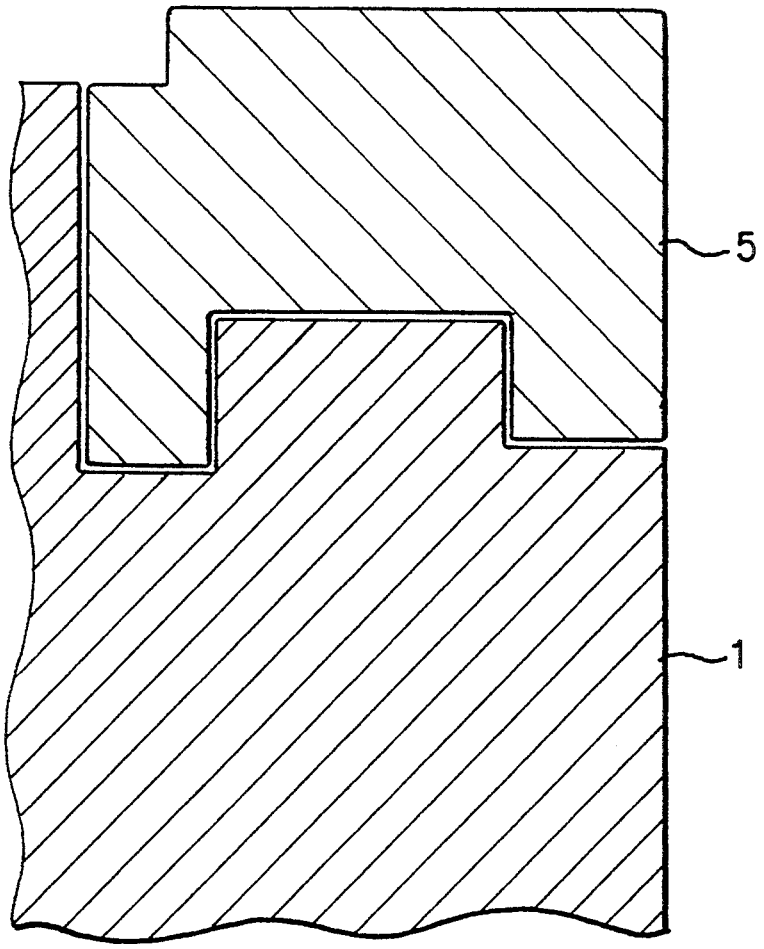

FIG. 3 shows a section of an embodiment of the junction between flange 5 and roll 1 according to the invention.

The flange 5 has a section essentially in U-form, and lays on the edge of roll 1, which has a complementary form.

Figure 4A:
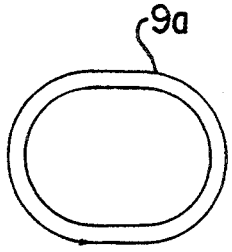
FIG. 4A is an enlarged profile of an oval-shaped seating on the flange.
Figure 4:
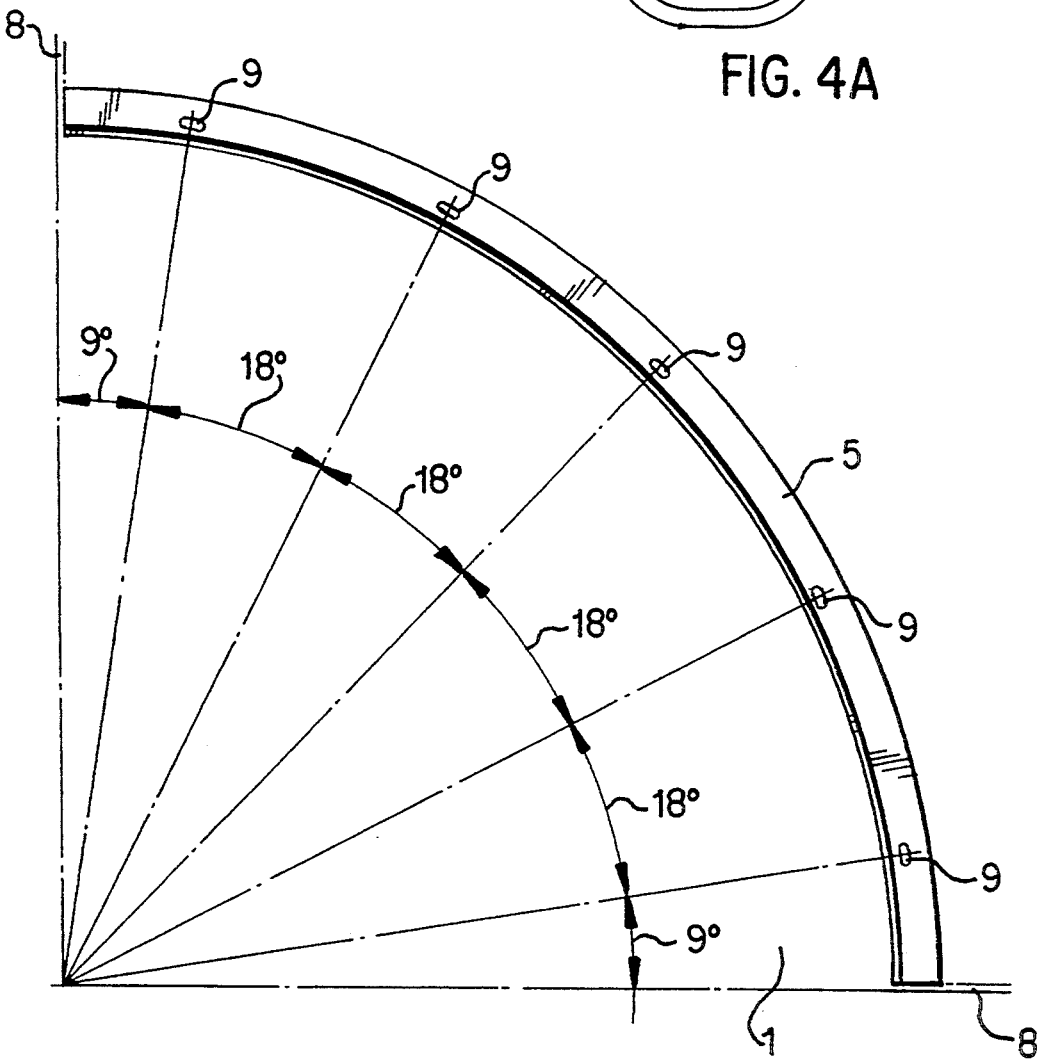

FIG. 4 shows another embodiment of the flange according to the invention.

The figure shows one of the four segments of the flange 5, substantially identical to each other, each covering an arc of 90°, to be laid on each flat base of roll 1. In one embodiment shown in FIG. 9, each of the seatings 9 are spaced 18° away from each other. Reference 8 indicates a gap between two contiguous ring segments. Additionally, the 9° designations separate the gap 8 from both the first and last seatings on the 90° flange.

The assembly is obtained with bolts inserted in appropriate seatings 9. As shown in FIG. 4A, 9*a* shows a preferred embodiment of an oval-shaped seating, where a bolt is inserted.

We claim:

1. A strip continuous casting machine comprising:

a pair of rolls, each roll having an outer cylindrical surface;

a plurality of flat bases, each flat base being connected to one end of a respective roll, each flat base extending perpendicular to an axis of rotation of the respective roll; and a plurality of annular flanges made of a material resistant to wear and to thermal cycling, wherein each flange is attached to one of the plurality of flat bases, the flange being positioned at an edge between the flat base and the cylindrical surface of the respective roll and protruding in an axial direction from the flat base.

2. The strip continuous casting machine of claim 1, wherein each flange is formed of a single piece of the material.

3. The strip continuous casting machine of claim 1, wherein each flange comprises a plurality of parts of the material, each part being one of a plurality of ring segments.

4. The strip continuous casting machine of claim 3, further comprising a corresponding gap formed between each pair of two adjacent parts.

5. The strip continuous casting machine of claim 4, further comprising a soft metal in each gap, the soft metal acting as a sealant.

6. The strip continuous casting machine of claim 5, wherein the soft metal is copper.

7. The strip continuous casting machine of claim 3, wherein each part is connected to the respective roll by a bolt.

8. The strip continuous casting machine of claim 7, wherein each flange has a plurality of oval-shaped seatings, and the bolt is insertable through the respective oval-shaped seating.

9. A strip continuous casting machine comprising:

a pair of counter-rotating rolls, a rotational axis of one of the pair of rolls being longitudinally displaced from a rotational axis of the other one of the pair of rolls;

each roll having an outer cylindrical surface and two flat bases, each roll having one flat base mounted to a first end of the roll and one flat base mounted to a second end of the roll, each flat base mounted perpendicular to the respective rotational axis;

a pair of confinement plates located at the first end and the second end of each roll; and a plurality of flanges, one flange being mounted on each flat base at an edge formed between said flat base and the cylindrical surface of the respective roll, each confinement plate contacting one flange on each flat base to define a cavity for casting molten metal, each flange mounted such that the respective confinement plate contacts an outer axial edge of the flange without contacting the corresponding flat base and the corresponding cylindrical surface, each flange formed of material resistant to wear and to thermal cycling.

10. The strip continuous casting machine of claim 9, wherein each flange protrudes in an axial direction from the respective flat base.

* * * * *